United States Patent [19]
Kanitz
[11] 4,317,569
[45] Mar. 2, 1982

[54] GOLF PRACTICE ROD

[76] Inventor: Lawrence L. Kanitz, 511 Park Ave., South Milwaukee, Wis. 53172

[21] Appl. No.: 150,080

[22] Filed: May 15, 1980

[51] Int. Cl.[3] ..... A63B 69/36
[52] U.S. Cl. ..... 273/200 B
[58] Field of Search ..... 273/200 R, 208, 195 R, 273/196, 197 R, 197 A, 200 B, 336, 427, 26 E, 198; 404/10, 11

[56] References Cited

U.S. PATENT DOCUMENTS

| | | | |
|---|---|---|---|
| 1,255,140 | 2/1918 | David | 273/208 X |
| 1,733,767 | 10/1929 | Yaggi | 273/196 |
| 2,121,961 | 6/1938 | Gill | 404/10 |
| 2,213,570 | 9/1940 | Rohland | 273/200 B |
| 2,884,250 | 4/1959 | Patterson | 273/26 E |
| 2,911,221 | 11/1959 | Butler | 273/196 |
| 3,101,949 | 8/1963 | Williams | 273/195 R X |
| 3,452,990 | 7/1969 | Nichols | 273/200 B X |
| 3,623,725 | 11/1971 | Setten | 273/26 E |
| 4,240,766 | 12/1980 | Smith et al. | 404/10 |

FOREIGN PATENT DOCUMENTS

| | | | |
|---|---|---|---|
| 210218 | 1/1924 | United Kingdom | 273/200 R |

*Primary Examiner*—George J. Marlo
*Attorney, Agent, or Firm*—Andrus, Sceales, Starke & Sawall

[57] ABSTRACT

The golf practice rod of the invention consists of an elongated tubular anchor for location vertically in the ground and a flexible shaft which extends through the anchor and in use protrudes above the ground to a predetermined distance to provide a target for a person desiring to practice a golf swing. Upward removal of the flexible shaft from the anchor is prevented by a horizontally extending flange, on the lower end of the flexible shaft, which engages the bottom end of the anchor. The upper end of the flexible shaft may be slotted to hold a wafer, which simulates a golf ball. In order to insert the anchor in the ground an implant tube of a size complimentary to the anchor is provided and the implant tube receives the upper end portion of the flexible shaft and abuts the upper end of the anchor. With this construction when the implant tube is engaged by a hammer or the like the anchor can be driven into the ground to the desired depth.

3 Claims, 5 Drawing Figures

GOLF PRACTICE ROD

BACKGROUND OF THE INVENTION

The invention is directed to a flexible shaft which may be supported by an anchor located in the ground and the shaft offers a target for a golfer desiring to improve his golf swing and train his eyes to keep them on the golf ball when the ball is hit.

BACKGROUND OF THE INVENTION

The invention in general is directed to a flexible shaft which is supported by an anchor located in the ground. The shaft extends through an elongated hole in the anchor and has an abutment which engages the bottom of the anchor to prevent the shaft from coming out of the anchor when it is struck by a golf club.

In order to aid in implanting the anchor in the ground a corresponding implant tube receives the upper end portion of the flexible shaft and abuts against the upper end of the anchor. The latter can then be driven into the ground a predetermined distance by hitting the implant tube on the top with a tool such as a hammer or the like. The implant tube is removed from the flexible shaft when the anchor is finally in place.

DESCRIPTION OF THE PREFERRED EMBODIMENT

Figure 1:
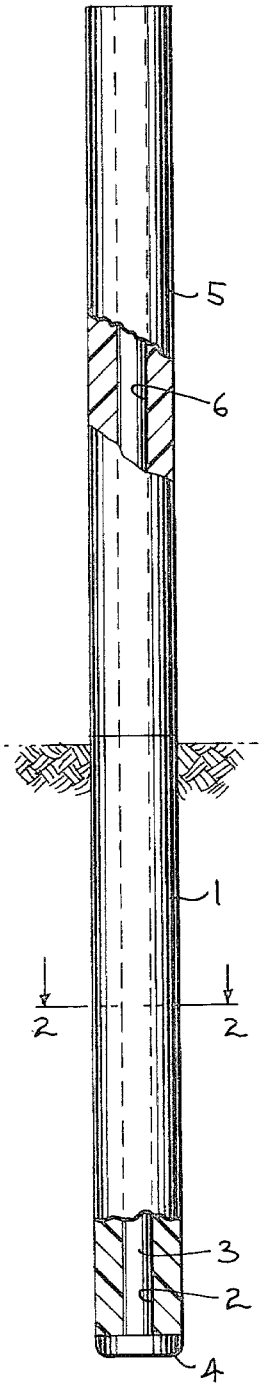
FIG. 1 is a side elevational view illustrating the parts of the practice rod assembled with the anchor having been driven into the ground to the desired depth.

The golf practice rod of the invention has an elongated cylinder which serves as an anchor 1 for insertion in the ground and which has an elongated hole 2 therethrough to receive the lower end portion of a flexible shaft 3 which may be of various colors. The lower end portion of shaft 3 has an abutment or flange 4 disposed over the bottom end of anchor 1 and this prevents flexible shaft 3 which is very resilient from pulling out of the top of anchor 1.

Anchor 1 is located in the ground at a predetermined depth and the flexible rod extends above the ground a predetermined distance normally depending upon the golf club which will be used by the person desiring to practice by use of the golf practice rod.

In order to locate anchor 1 in the ground an implant tube 5 corresponding in size to anchor 1 is provided. Implant tube 5 has an elongated hole 6 to receive the upper end portion of flexible shaft 3 and the bottom end of tube 5 abuts against the top of anchor 1.

Figure 3:
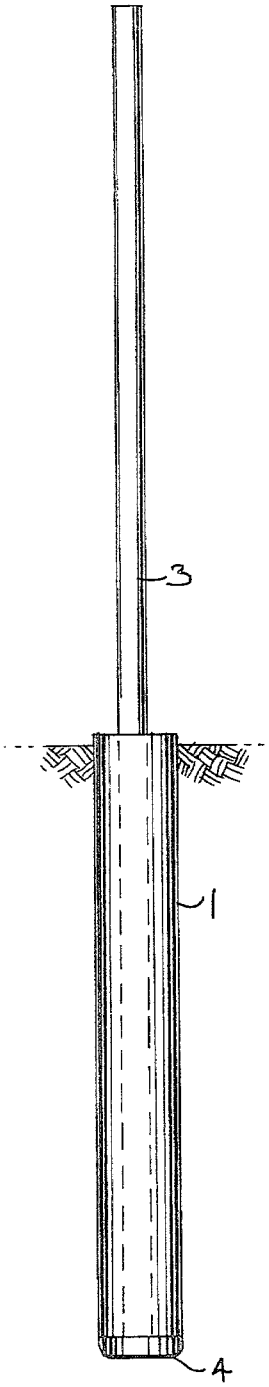
FIG. 3 is an elevational view of the golf practice rod with the implant tube removed and disposing the flexible rod in a position to be engaged by a golf club.
Figure 2:
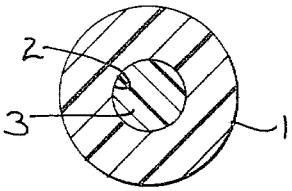
FIG. 2 is a section taken on line 2—2 of FIG. 1.

By using a tool such as a hammer or the like which engages the top of implant tube 5 anchor 1 may be driven into the ground to the depth desired. After this is accomplished implant tube 5 is removed which leaves flexible shaft 3 in a position above anchor 1 as shown in FIG. 3 ready to be engaged by a golf club and to flex when hit and then return to its initial position.

Anchor 1 may be located at various heights in the ground to support the upper portion of flexible shaft 3 above the ground and the depth of anchor 1 and the height of flexible shaft 3 above the ground wall normally depend upon the golf club which will be used to hit flexible shaft 3.

The golf practice rod is designed to improve the swing of the golfer as well as to train the golfer to keep his eyes on the target he is hitting both of to improve the golfer's golf game in actual play.

The golf practice rod can be made of various lengths depending upon the golf clubs with which it is to be employed.

Flexible resilient shaft 3 which can be made of nylon or like material is easily replaceable in the event it loses its flexibility by use or is injured so that it no longer will flex when engaged by a golf club.

Figure 4:
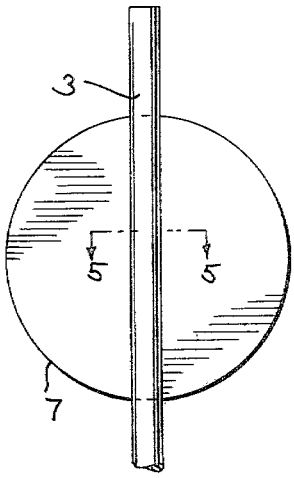
FIG. 4 is an elevational view showing a wafer or chip inserted through a slot in the flexible shaft.
Figure 5:
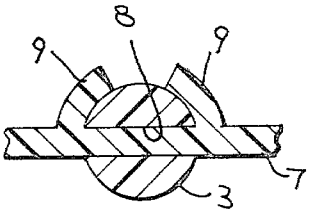
FIG. 5 is a section taken on line 5—5 of FIG. 4.

A second embodiment of the invention is illustrated in FIGS. 4 and 5 of the drawing. In this embodiment after anchor 1 is located in the ground a wafer 7 to simulate a golf ball is inserted through the slot 8 in flexible shaft 3. After insertion wafer 7 is held in place by the clips 9 as illustrated in FIG. 5 which are located opposite to the side of the wafer which will be hit by a golf club during practice. The clips may be of various shapes and configurations. Because the shaft 3 is inherently resilient this feature provides all the flexibility in the shaft which is required without the addition of any other member thereto. Various modes of carrying out the invention are contemplated as being within the scope of the following claims, particularly pointing out and distinctly claiming the subject matter which is regarded as the invention.

I claim:

1. A golf practice rod which comprises a hollow rigid anchor located vertically in the ground, an upright elongated flexible shaft separate from the anchor and having a lower end portion extending through the anchor to secure the shaft therein and an upper end portion projecting vertically upwardly from the anchor and the ground and means on the bottom end of the flexible shaft preventing upward removal of the shaft from the anchor, and the upper end portion of the shaft being sufficiently flexible to flex in the area immediately above the upper end of the anchor horizontally from a vertical position when struck by the head of a golf club swung by a person standing on the ground adjacent the anchor and flexible shaft and then return to its initial position.

2. The golf practice rod of claim 1, and the flexible shaft extending through an elongated hole in the anchor, and the means on the flexible shaft preventing upward removal of the flexible rod from the anchor being a horizontally extending flange secured to the lower end of the rod which engages the bottom end of the anchor.

3. The golf practice rod of claim 1 and an implant tube which corresponds in length to the portion of the rod projecting above the anchor of the general size of the anchor and having a longitudinal passage thereon to receive the upper end portion of the flexible shaft disposed to be initially assembled with the anchor and flexible shaft to engage the upper end of anchor to thereby provide for insertion of the anchor into the ground when the implant tube is engaged at the top by a hammer or the like.

* * * * *